US006863950B1

(12) United States Patent
Cunningham

(10) Patent No.: US 6,863,950 B1
(45) Date of Patent: Mar. 8, 2005

(54) PUNCTURE PROOF MATERIAL WITH CAPTURE DEVICES

(76) Inventor: Frank W. Cunningham, 4918 Elmdale, Rolling Hills, CA (US) 90274

( * ) Notice: Subject to any disclaimer, the term of this patent is extended or adjusted under 35 U.S.C. 154(b) by 82 days.

(21) Appl. No.: 10/336,770

(22) Filed: Jan. 4, 2003

Related U.S. Application Data

(60) Continuation-in-part of application No. 09/923,886, filed on Aug. 7, 2001, now abandoned, which is a division of application No. 09/502,836, filed on Feb. 11, 2000, now Pat. No. 6,272,687.

(51) Int. Cl.[7] ..... B32B 3/10; B32B 15/00; B21C 27/00

(52) U.S. Cl. ..... 428/136; 428/598; 428/596; 428/615

(58) Field of Search ..... 428/598, 577, 428/590, 615, 593, 596, 136; 245/8, 7, 11

(56) References Cited

U.S. PATENT DOCUMENTS 297,631 A * 4/1884 Plimsoll ..... 428/598
3,690,606 A * 9/1972 Pall ..... 428/605
6,450,208 B1 * 9/2002 Khokar ..... 139/11

* cited by examiner

*Primary Examiner*—Harold Pyon
*Assistant Examiner*—Patricia L. Nordmeyer
(74) *Attorney, Agent, or Firm*—Lee W. Tower

(57) ABSTRACT

A puncture proof material is provided. The material includes a first mat that is woven using metal strips forming a warp and a weft of the first mat. The metal strips have a capture device near the center of each intersection of the warp and weft of the first mat. The capture device can be implemented with a hole, depression or etched rectangular hole near the center of each intersection of the warp and weft of the first mat. A second mat, woven of metal strips having a capture device near the center of each intersection of the warp and weft of the second mat, overlays the first woven mat. Additional mats can be overlaid to increase the puncture proof characteristic of the material. Another capture device implementation includes a top layer woven of annealed metal foil of relatively low tensile strength overlaid over other randomly overlaid layers each woven of metal foil of higher tensile strength.

12 Claims, 11 Drawing Sheets

PUNCTURE PROOF MATERIAL WITH CAPTURE DEVICES

This application is a continuation in part of patent application Ser. No. 09/923,886 filed Aug. 7, 2001, now abandoned, which is a division of patent application Ser. No. 09/502,836, filed Feb. 11, 2000, and issued Aug. 14, 2001 as U.S. Pat. No. 6,272,687. The subject matter of all of the above referenced patent applications, continuations in part applications and issued patents are incorporated herein by this reference, as though set forth in full.

BACKGROUND OF THE INVENTION

This invention relates to a protective puncture proof material to protect against accidental injuries from needles, scalpel blades, knives and other sharp pointed instruments.

DESCRIPTION OF THE RELATED ART

Protection from accidental cuts and punctures is needed in the fields of medicine and law enforcement, and in any occupation where sharp instruments are encountered and where the combination of flexibility and protection against cuts and puncture wounds is needed.

Accidental needle sticks and scalpel blade cuts occur to doctors and nurses, while performing surgery, giving injections, taking blood samples, and administering intravenous liquids. The accidental needle sticks and scalpel blade cuts by themselves are harmful; however, in a medical situation a cut or puncture can also transmit infection either to the patient or to the medical person performing the procedure.

In the past, the main concern was that a surgeon would infect the patient during surgery. This is still a concern and is adequately addressed by using latex gloves. Unfortunately, it is also increasingly crucial to protect surgeons and other medical personnel from infection. A surgeon can contract hepatitis, AIDS, and other diseases, when the blood or body fluid of a patient is transmitted through the skin of the surgeon. It is estimated that the average surgeon has about three cuts or puncture wounds per month, caused by either a hypodermic needle or a scalpel blade. This presents an unacceptable risk factor for surgeons and other medical personnel.

The CDC (Centers for Disease Control and Prevention) has estimated the number of percutaneous (through the skin) injuries per year in the United States. Each year there are 30 reported injuries per 100 occupied hospital beds. Since there are 600,000 occupied hospital beds in the United States, there are 180,000 reported percutaneous injuries reported per year. In addition the CDC estimates that 39% of the incidents are not reported according to the survey conducted. Also, the CDC doubles the resulting figure because 50% of healthcare workers are employed outside of hospital settings. The total estimated number of percutaneous injuries per year is 590,194.

The risks of infection following a single HIV (human immunodeficiency virus), HBV (hepatitus B virus), or HBC (hepatitus C virus) contaminated needlestick or sharp instrument injury are 0.3%, 6%–30%, and 1%–10%, respectively. Clearly surgeons and other health care workers are facing a high risk of infection from needlesticks and other sharp instruments.

Conventionally, surgeons and other medical personnel wear sterilized latex gloves, which are thin and flexible enough to enable a surgeon to freely manipulate his fingers, and to utilize his sense of touch. If the latex gloves are not penetrated then the patient and the surgeon are protected from infection; however, latex gloves offer hardly any protection against accidental punctures or cuts, because hypodermic needles and scalpel blades can easily puncture or cut through a latex glove. Even multiple layers of latex gloves, which medical personnel increasingly use to provide additional protection against transmission of infection, offer no protection against accidental punctures or cuts.

It is important to distinguish between cuts and puncture wounds. A cut is typically from the edge of a scalpel blade. A puncture wound can be caused by the point of a scalpel blade or by the point of a hypodermic needle. A scalpel blade is typically about 0.75 inches long with a sharpened edge and with a point about 0.010 inches in diameter. A hypodermic needle can be as small as 0.010 inches in diameter at the point widening to about 0.018 inches in diameter for the shaft of a No. 27 needle. It is much easier to protect against a cut from an edge of a scalpel blade than to protect against a puncture from either a scalpel blade or a hypodermic needle, because a scalpel blade has a wider surface upon which the pressure of the cut is distributed. For example, if the pressure is 2000 grams, then the pressure per square area for a scalpel blade is 2000/(0.75*0.010), assuming the edge of the scalpel blade is the same sharpness as the point of the scalpel blade (0.010 inches) and that the scalpel blade is 0.75 inches long. For a needle with a 0.010 diameter point the same pressure would have a pressure per square area of $2000/(3.14*(0.010/2)^2)$, which is ninety five times greater than the pressure per square area for the edge of a scalpel blade. This factor of approximately one hundred is a key reason that conventional protective gloves fail to offer adequate protection against punctures.

Most accidents in the operating room occur with some significant force. For example, a surgeon turns and is wounded accidentally by the point of a needle or scalpel being handed to him by a nurse or, a surgeon while suturing slips and punctures his hand with a needle. Effective protection against punctures should protect against pressures up to approximately 1500 to 1800 grams. This level of protection is well beyond the protection provided by the conventional puncture resistant gloves.

Conventional approaches to providing increased protection beyond latex gloves against cuts and punctures for a surgeon or other medical personnel include: providing a glove with a weave or knit of a material such as Kevlar, nylon, stainless steel or fiberglass; providing reinforced areas such as on glove fingers; placing foam material between two latex gloves; and providing leather on portions of the glove. Some of the materials, such as leather and Kevlar knits provide protection against cuts, but virtually no protection against punctures.

Conventional protective gloves having a simple weave or knit of a material such as Kevlar, nylon, stainless steel or fiberglass are characterized by U.S. Pat. Nos. 4,526,828, 5,070,540, 4,833,733, 5,087,499, 4,742,578, and 4,779,290. These approaches have fairly effective protection against cuts, because a material such as a Kevlar weave is hard to cut through. However, a shortcoming of all of these approaches is that the weave or knit is simply spread apart by the wedge on a needle or scalpel point to form a passage as the needle or scalpel point is inserted into the material. Making the weave tighter or thicker does not prevent punctures; moreover, a thicker or tighter weave significantly reduces the flexibility of these gloves and their usefulness. As the number of layers or the thickness of the material increases, the ability of a surgeon to freely manipulate his fingers, and to utilize his sense of touch is significantly reduced.

Conventional protective gloves providing reinforced areas are characterized by U.S. Pat. No. 4,865,661, which has woven fiberglass placed at certain areas on the fingers of a glove and U.S. Pat. No. 5,187,815, which has corrugated metal foil in areas to be reinforced. The shortcoming of these approaches is that the reinforced areas have little flexibility so can only be placed on certain areas, which leaves the rest of the glove without the same protection. Also, even woven fiberglass and corrugated metal may be punctured. The point of a #11 blade will easily pass through metal foil ½ to 1 mil thick.

The approach of placing foam material between two latex layers is the approach of U.S. Pat. No. 4,901,372, which provides little if any protection against cuts and punctures, because the latex and the foam can be easily cut and punctured.

Providing leather on a glove is an approach that provides some protection to cuts; however, little protection to punctures. Even though the pores of the leather may be smaller than the diameter of a needle, a needle will simply make a hole in the leather as it passes through.

A flexible puncture proof material is described in U.S. Pat. No. 5,601,895 issued to Frank W. Cunningham, M. D. on Feb. 11, 1997. U.S. Pat. No. 6,272,687 issued to Frank W. Cunningham, M. D. on Aug. 14, 2001 describes a puncture proof material used for a puncture proof surgical glove.

The requirements for a flexible puncture proof material suitable for demanding uses such as surgery are: 1. absolute maximal flexibility; 2. conformability to compound curves; 3. elasticity; and 4. the thinnest possible puncture resistant material, for tactile transmission/touch perception.

There is a need in the art for a puncture proof material that is flexible and protects against accidental puncture injuries from needles, scalpel blades and other sharp pointed instruments.

SUMMARY OF THE INVENTION

It is an object of this invention to provide a puncture proof material that provides flexibility and elasticity and protects against dangerous puncture wounds from needles and scalpels.

Other objects and many of the attendant features of this invention will be more readily appreciated as the same becomes better understood by reference to the following detailed descriptions and considered in connection with the accompanying drawings in which like reference symbols designate like parts throughout the figures.

DETAILED DESCRIPTION

The requirements for a material suitable for a puncture resistant surgical underglove are extreme and demand flexibility, elasticity, conformity to a compound curve of very small radius (1 to 2 millimeters), maximal tactile transmission of touch, and puncture resistance in the range of 1,800 grams. The use of woven strips of material provides stability against rotation of the strips in their own axis. If the woven strips have a "capture element", then a needle point encountering the material will not simply slide past successive layers of the material seeking an opening. In particular the specific requirements for such a material include the following. The woven material should provide a "capture element" to arrest the progress of a needle or other sharp instrument point in contact with the material. The strips of the woven material should be thin with as narrow as possible width to enhance flexibility, and elasticity at 45 degrees to an x-y axis of the woven material. The material should have as few as possible number of layers to enhance tactile transmission. The number of layers is a function of the tensile strength of the material, and relates also to the number of layers to achieve full coverage of the area without any "voids" in the woven material that would allow passage of a needle or other sharp instrument, such as a knife point.

Figure 1A:
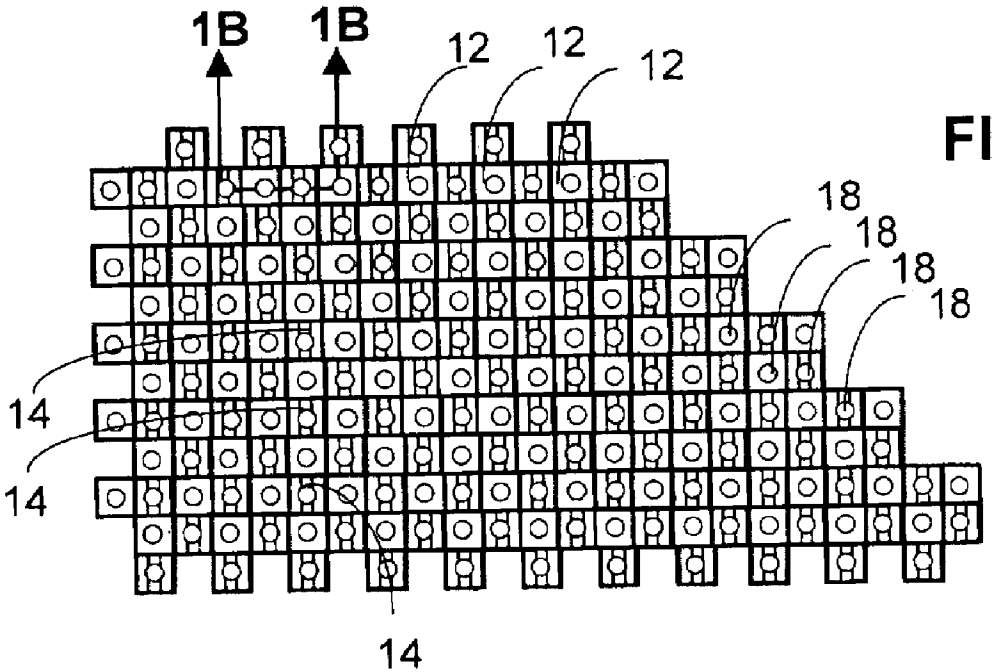
FIG. 1A is a portion of a puncture proof material formed by weaving strips with capture devices in accordance with the present invention.

With these requirements and referring now to the drawings, FIG. 1A is a portion of a puncture proof material 20 formed by weaving strips 12 and 14, which are made of ribbon wire or metal foil having cross section dimensions that are approximately 15 mils wide by 1 mil thick. Holes 18 are placed in the strips 12 and 14 and centered between four intersections of the warp and weft of the woven strips to act as capture devices, as further explained below. A sharp instrument such as a needle encountering the hole will be captured by the hole, which prevents the sharp instrument from skidding along the puncture proof material. Stopping the skidding can prevent the needle from coming into contact with a body area not protected by puncture proof material.

Figure 1B:
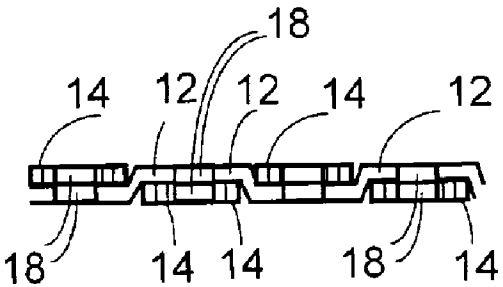
FIG. 1B is a section along line 1B—1B of FIG. 1A showing a portion of a puncture proof material formed by weaving strips in accordance with the present invention.
Figure 1C:
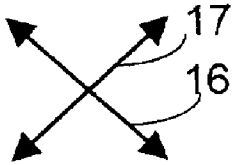
FIG. 1C shows that the woven material of FIG. 1A has elasticity in the 45-degree axis in accordance with the present invention.

FIG. 1B is a section along line 1B—1B of FIG. 1A showing a portion of the puncture proof material formed by weaving strips. The holes 18 extend through woven strips 12 and 14 of the warp and weft. The woven mat has elasticity in the 45-degree axis as shown by axes 16 and 17 in FIG. 1C.

Figure 2C:
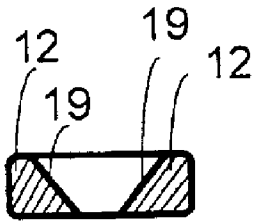
FIG. 2C is an elevational section along line 2C—2C of FIG. 2B in accordance with the present invention.
Figure 2A:
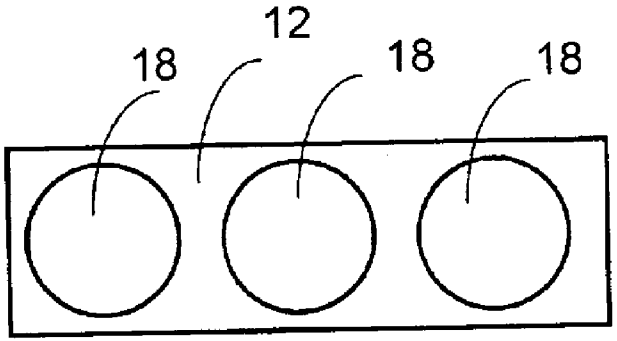
FIG. 2A is a detail showing a portion of a metal strip having holes in the material in accordance with the present invention.
Figure 2B:
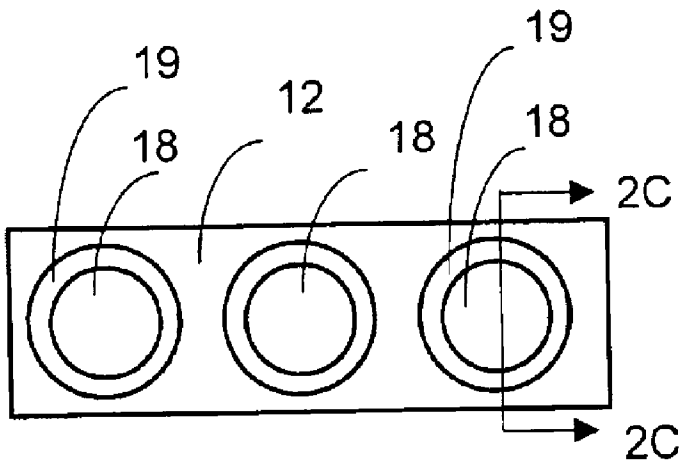
FIG. 2B is a detail showing a portion of a metal strip having beveled holes in the material in accordance with the present invention.

FIG. 2A is a detail showing a portion of strip 12 having holes 18 to form capture devices in the material. The holes can be placed at the centers of the warp and weft after the strips are woven, or can be placed in the strips before weaving. Either an electrical discharge machine or a laser beam can form the holes. The advantage of electrical discharge machining is that it produces a hole with beveled or angular sides, which results in the largest possible hole at the top to maximize capture, with minimal loss of mass and strength, because less material is removed at the bottom of the hole. Alternately, etching can be used to form the holes. An etched hole has a similar advantage in that there is maximal capture with a large hole at the top and minimal loss of mass and strength, because less material is removed at the bottom of the etched hole, which again has angular or beveled sides. FIG. 2B is a detail showing a portion of metal strip 12 having holes 18 in the material and having beveled sides 19, as indicated in FIG. 2C, which is an elevational section along line 2C—2C of FIG. 2B. As discussed below, the holes can also be formed of alternate shapes, including rectangular.

Figure 3:
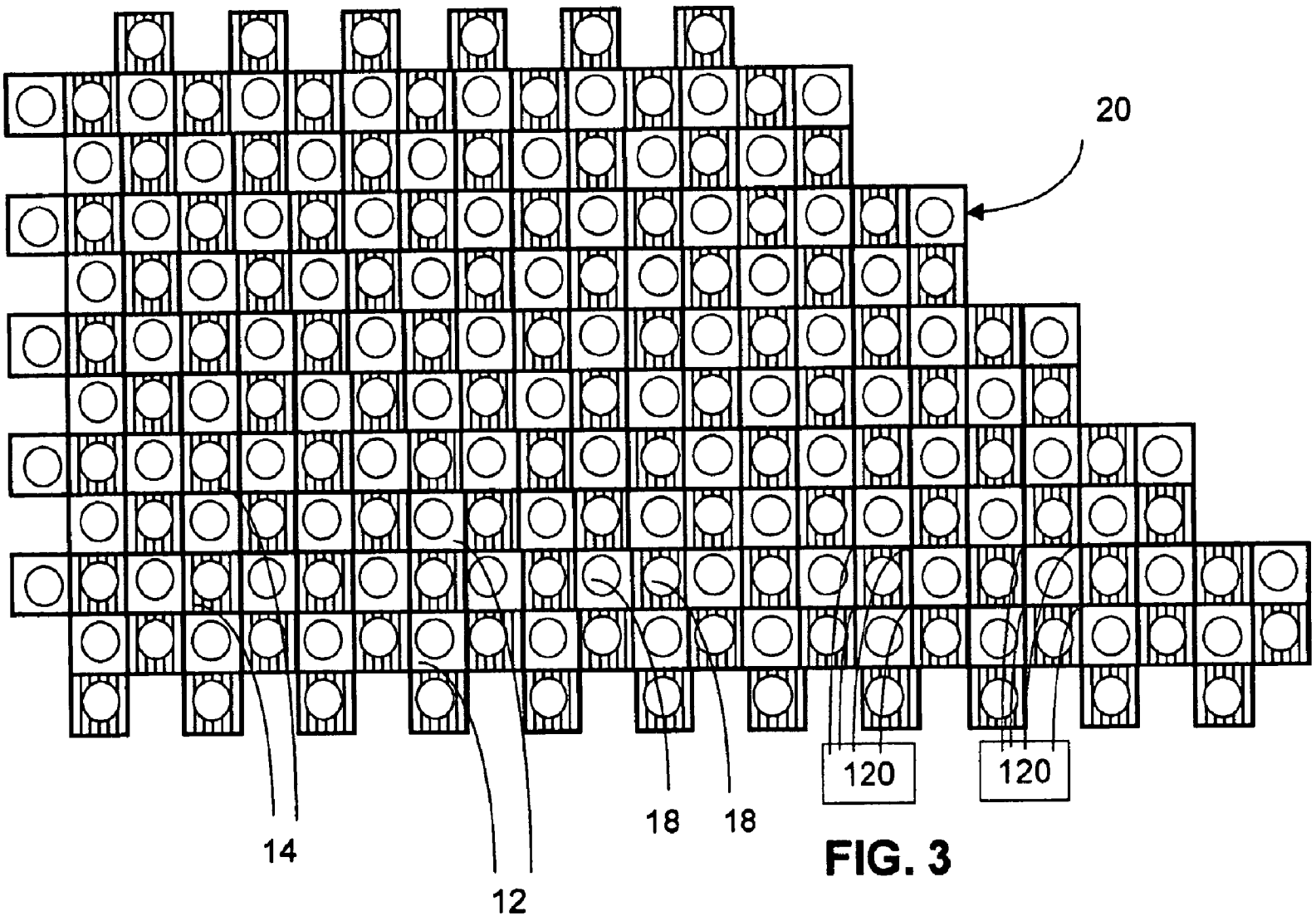
FIG. 3 is a expanded view of the puncture proof material of FIG. 1A showing one layer with capture devices consisting of holes placed in woven strips in such a manner that each hole in the strips is centered between four intersections or voids of the warp and weft of the woven strips in accordance with the present invention.

FIG. 3 is a expanded view of the puncture proof material of FIG. 1A showing the one woven layer 20 with capture devices consisting of holes 18 placed in the strips 12 and 14 in such a manner that when the strips 12 and 14 are woven that each hole 18 in the strips 12 and 14 is centered between four intersections 120 of the warp and weft. To form a puncture proof material, multiple layers must be placed in registry relative to one another, because there are "voids" at the intersections 120 of the warp and weft of the woven strips. The intersections 120 are at each of four corners of each crossing of the warp and weft. While each void is very small, (1 to 2 mils), it is a potential path for a needle. However, if multiple layers of woven strips are layered and offset so that multiple layers are positioned so that all voids are covered by one of the layers, then there is no potential path for the needle. The capture devices consisting of holes 18 are placed in the strips 12 and 14 in such a manner that when the strips 12 and 14 are woven that each hole 18 is centered between four intersections 120 of the warp and weft. A sharp instrument such as a needle encountering a hole 18 is captured by the hole, which prevents the sharp instrument from skidding and coming into contact with a body area not protected by the puncture proof material.

Figure 4:
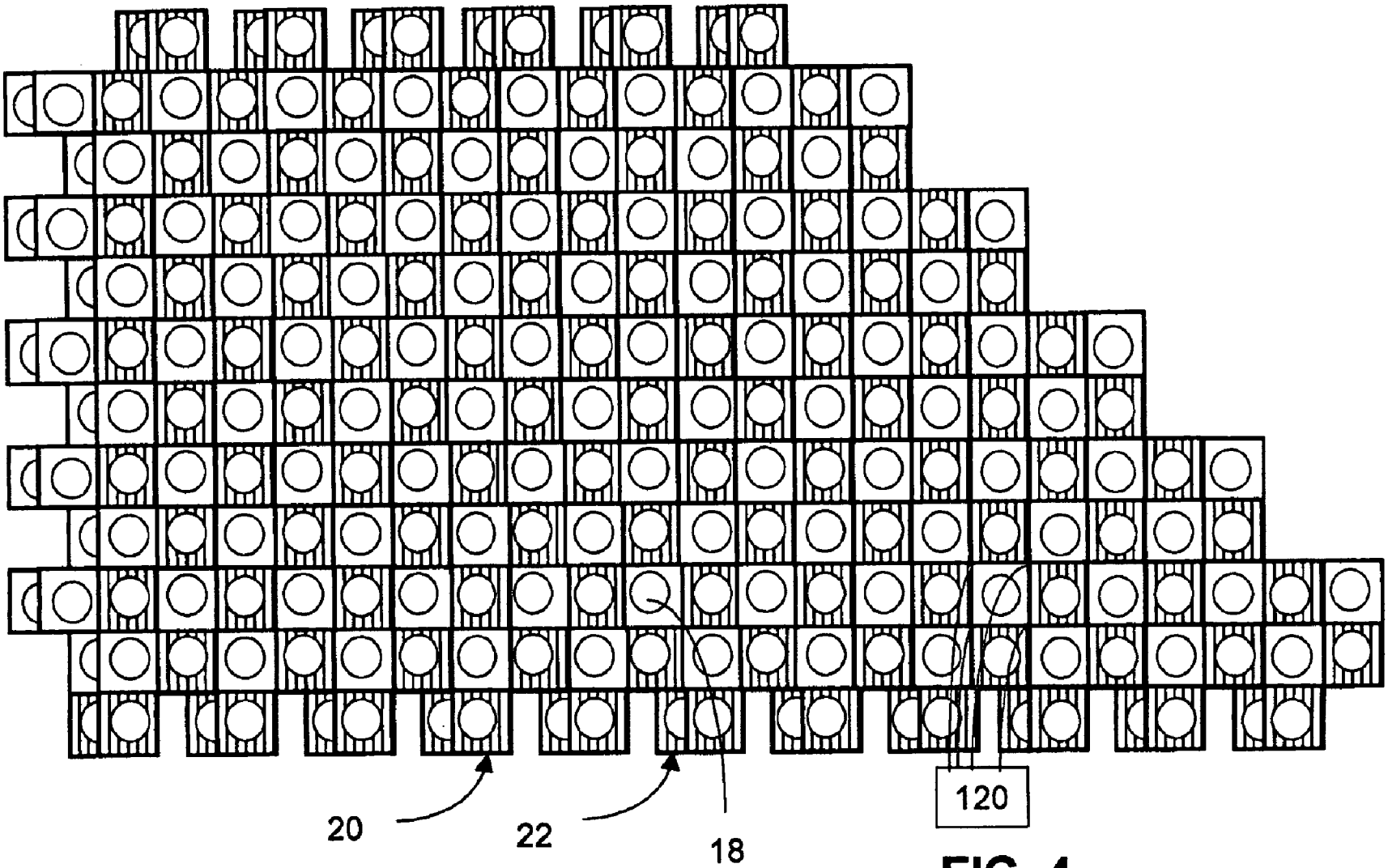
FIG. 4 shows two overlapping but offset woven layers with each layer having capture devices consisting of holes placed in woven strips in such a manner that each hole in the strips is centered between four intersections or voids of the warp and weft of the woven strips and the voids of the two overlapping layers do not overlap in accordance with the present invention.

FIG. 4 shows two overlapping but offset woven layers 20 and 22, with each layer having capture devices consisting of holes 18 placed in the strips 12 and 14 of each layer in such a manner that when the strips 12 and 14 are woven for each layer that each hole 18 in the strips 12 and 14 is centered between four intersections 120 of the warp and weft.

Figure 5:
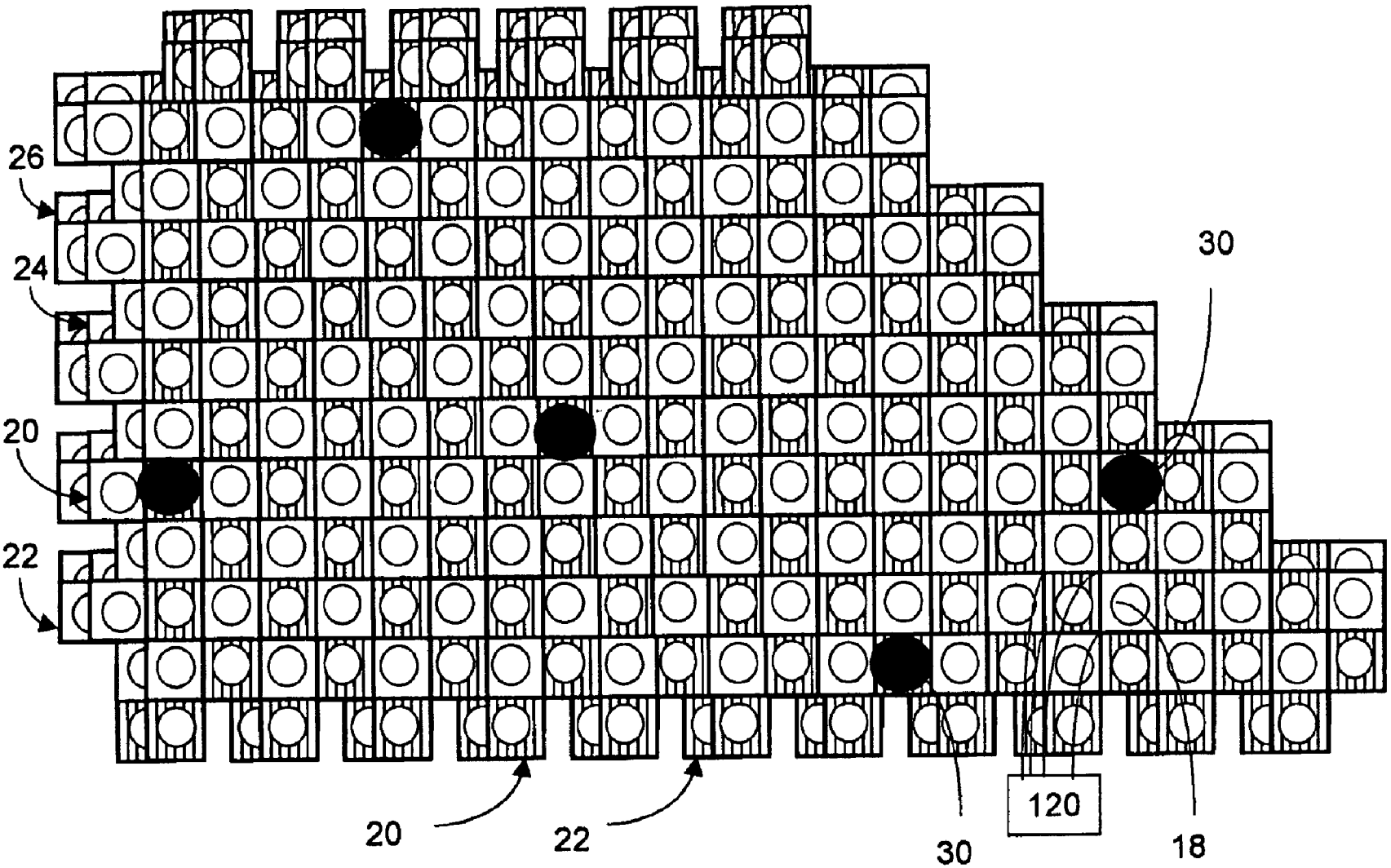
FIG. 5 shows four overlapping but offset woven layers joined by pins with each layer having capture devices consisting of holes placed in woven strips in such a manner that each hole in the strips is centered between four intersections or voids of the warp and weft of the woven strips in accordance with the present invention.
Figure 6B:
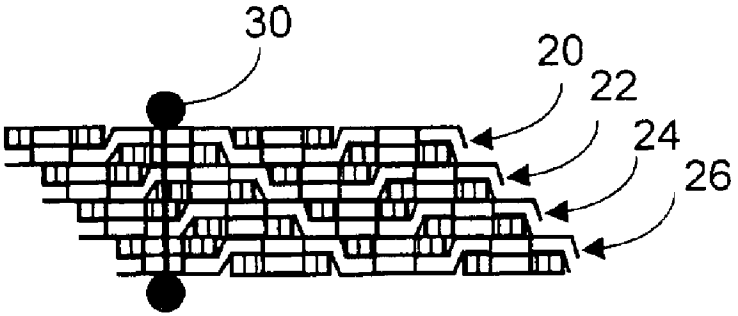
FIG. 6B shows a pin traversing 4 woven layers of the puncture proof material in accordance with the present invention.
Figure 6A:
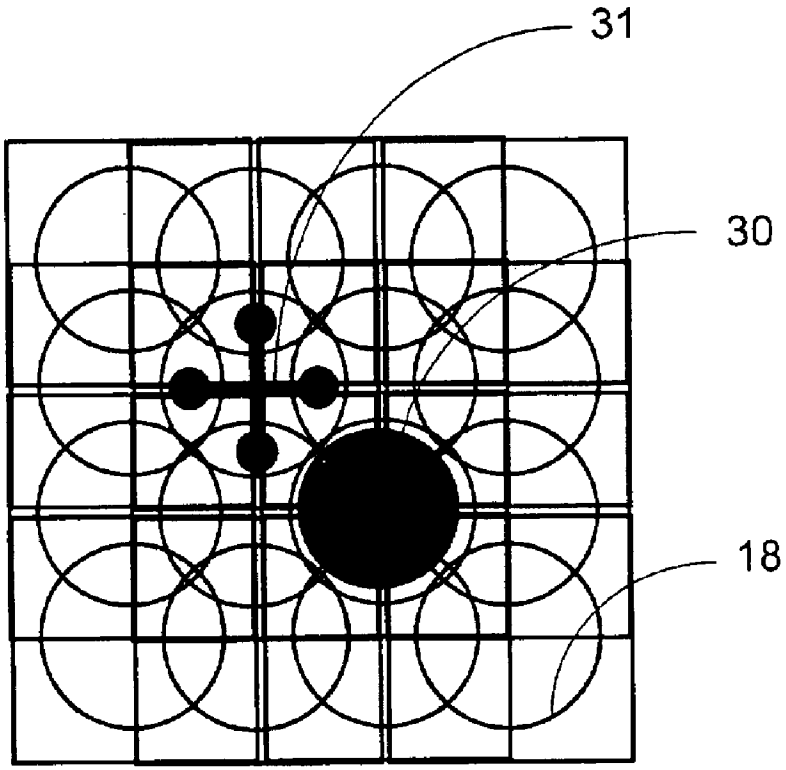
FIG. 6A shows the placement of pins or wire loops that maintain the registry of the overlapped and offset woven layers in accordance with the present invention.

FIG. 5 shows four overlapping but offset woven layers 20, 22, 24, and 26 joined by pins 30 with each layer having capture devices consisting of holes 18 placed in the strips 12 and 14 of each layer in such a manner that when the strips 12 and 14 are woven for each layer that each hole 18 in the strips 12 and 14 is centered between four intersections 120 of the warp and weft. Pins 30 or wire loops 31 maintain layer registry as shown in FIG. 6A. The pins 30 traverse and join all four woven layers, as shown in FIG. 6B. If the wire loops 31 are used, then the wire loops also join all four woven layers. To enhance flexibility, such pins or wire loops have a diameter that is no greater than approximately ½ the diameter of the hole 18. Such four-point registry pins need only be placed at very wide intervals.

With the puncture proof material of FIG. 5 with four layers of woven strips, there is zero probability that a needle point would find a path through the material due to the fixed registry that ensures that voids at the intersections 120 of the warp and weft of one layer are compensated for by having no voids in the same location in other layers. The vertical pins 30 or wire loops 31 ensure that each layer will remain in the same relative position to the other layers when subjected to flexing or stretching.

To simplify fabrication and manufacturing the multiple layers of woven strips can be stacked or layered in a random non registered manner. Any voids at the intersections 120 of the warp and weft of the woven strips (1 to 2 mils) are potential paths for a needle to pass through. However, if a second woven layer is placed in a position of "non-registry", the non-void area of one layer can cover the voids of the other layer. The probabilities are favorable that "coincident" voids would not occur. For a four layer stack of woven mats layered in a random manner, given a 15 mil wide ribbon wire and voids of 2 mils by 2 mils, the probability of a puncture has been calculated to be 1 in 25,000,000.

Figure 7:
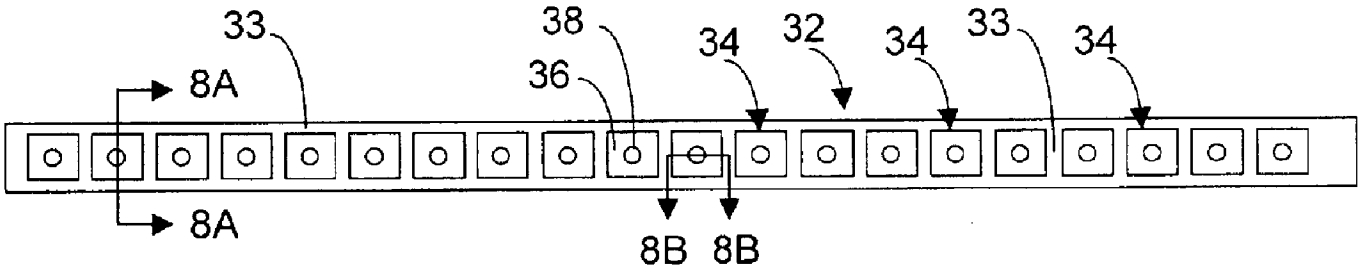
FIG. 7 shows a ribbon wire with capture devices consisting of depressions in accordance with the present invention.
Figure 8B:
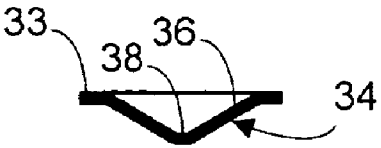
FIG. 8B is an elevational section along line 8B—8B of FIG. 7 in accordance with the present invention.
Figure 8A:
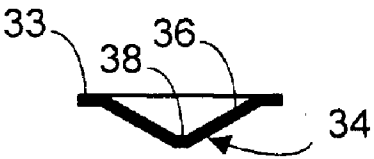
FIG. 8A is an elevational section along line 8A—8A of FIG. 7 in accordance with the present invention.

There are alternates to holes 18 for capture devices. FIG. 7 shows a ribbon wire 32 with capture devices consisting of depressions 34. Each depression 34 has angular sides 36 leading to a bottom 38. Around the depressions are sections 33 of the ribbon wire 32 that are not deformed. The ribbon wire or metal foil has cross section dimensions that are approximately 15 mils wide by 1 mil thick before the depressions are formed in the ribbon wire. FIG. 8A is an elevational section along line 8A—8A of FIG. 7, and FIG. 8B is an elevational section along line 8B—8B of FIG. 7.

Figure 9:
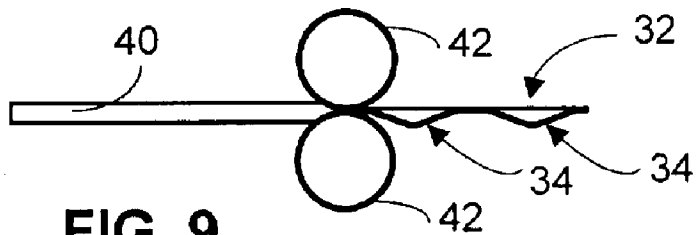
FIG. 9 shows a roller die forming depressions in ribbon wire in accordance with the present invention.

FIG. 9 shows a roller die 42 forming depressions in undeformed ribbon wire 40. The roller die can be used to form strips with depressions or pits. This can be a continuous process. One advantage of this configuration is that it leaves the maximum amount of metal for strength, to resist puncture. The pit 34 so formed is in the shape of a truncated pyramid, pointed downward. Very narrow edges are left to provide the maximum ratio of "pit" area to flat surface area. The strips are woven as in FIG. 1A except that the capture devices are depressions or pits.

Multiple layers of woven strips 32 are stacked or layered in a random manner, each layer to the next, simplifying fabrication and manufacturing. Since the flat area 33 relative to the pit area 34 is small, a needle impacting a flat area would either be deflected into the pit and captured, or would be deflected to the next layer down which would capture the sharp instrument. As discussed above, any voids at the intersections of the warp and weft of the woven strips (1 to 2 mils) are potential paths for a needle to pass through. However, if a second woven layer is placed in a position of "non-registry", the non-void area of one layer can cover the voids of the other layer. The probabilities are favorable that "coincident" voids would not occur, due to the small void and large flat areas. For a four layer stack of woven mats layered in a random manner, given a 15 mil wide ribbon wire and voids of 2 mils by 2 mils, the probability of a puncture has been calculated to be 1 in 25,000,000.

Figure 10:
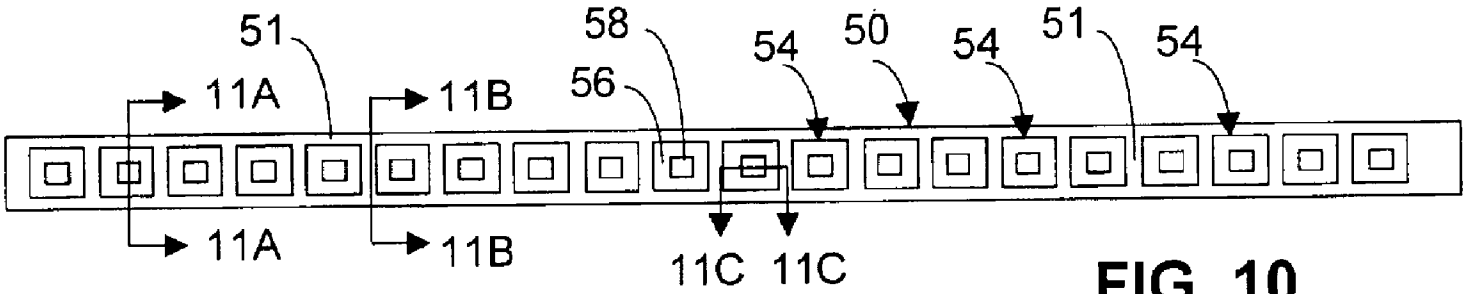
FIG. 10 shows a ribbon wire with capture devices formed by etching holes in the ribbon wire in accordance with the present invention.
Figures 11A, 11B, 11C:
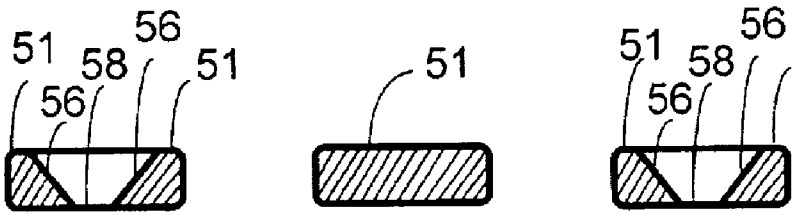
FIG. 11A is an elevational section along line 11A—11A of FIG. 10 in accordance with the present invention.
FIG. 11B is an elevational section along line 11B—11B of FIG. 10 in accordance with the present invention.
FIG. 11C is an elevational section along line 11C—11C of FIG. 10 in accordance with the present invention.

FIG. 10 shows a ribbon wire 50 with capture devices formed by etching holes 54 in the ribbon wire. Each etched hole 54 is square at the top with angular sides 56 leading to an opening 58. Around the depressions are sections 51 of the ribbon wire 50 that are not etched. The ribbon wire or metal foil has cross section dimensions that are approximately 15 mils wide by 1 mil thick before the etched holes are formed in the ribbon wire. FIG. 11A is an elevational section along line 11A—11A of FIG. 10, FIG. 11B is an elevational section along line 11B—11B of FIG. 10, and FIG. 11C is an elevational section along line 11C—11C of FIG. 10.

Figures 12A, 12B, 12C:
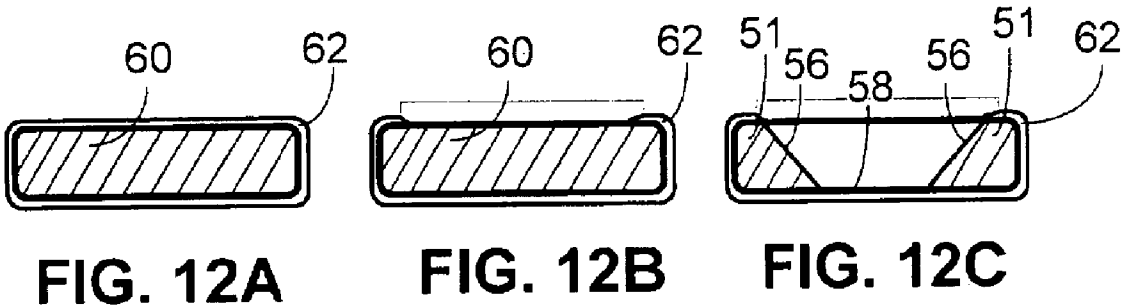
FIG. 12A shows a cross section of the ribbon wire with the ribbon wire completely coated with photo resist in preparation for etching in accordance with the present invention.
FIG. 12B shows the cross section of the ribbon wire after a portion of the photo resist has been removed through methods involving masking and light exposure of the photo resist.
FIG. 12C shows the cross section of the ribbon wire of FIG. 12B after the etching process to form a hole in the ribbon wire. This step is done in parallel along a length of the ribbon wire to form the ribbon wire with capture devices of FIG. 10 in accordance with the present invention.

Again, the maximal area of the etched hole 54 to the non-etched area is sought, with the constraint that the metal left has the required strength. FIGS. 12A, 12B and 12C show the photo etching process. FIG. 12A shows a cross section of the ribbon wire with the ribbon wire completely coated with photo resist in preparation for etching. FIG. 12B shows the cross section of the ribbon wire after a portion of the photo resist has been removed after masking and light exposure of the photo resist. FIG. 12C shows the cross section of the ribbon wire of FIG. 12B after the etching process to form a hole in the ribbon wire. The etching process can be performed in parallel along a length of the ribbon wire and can be a continuous or reel to reel process.

Multiple layers of woven strips 50 are stacked or layered in a random manner, each layer to the next, simplifying fabrication and manufacturing. A sharp instrument such as a needle is captured by the etched holes. Any voids at the intersections of the warp and weft of the woven strips (1 to 2 mils) are potential paths for a needle to pass through; however, a four layer stack of woven mats, layered in a random manner, has a probability of a puncture of only 1 in 25,000,000.

Figure 13A:
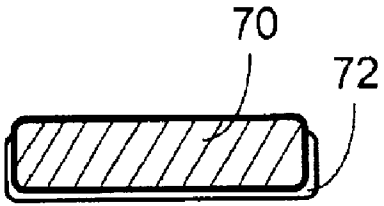
FIG. 13A shows the ribbon wire with a coating on the bottom to mask the bottom in accordance with the present invention.
Figure 13B:
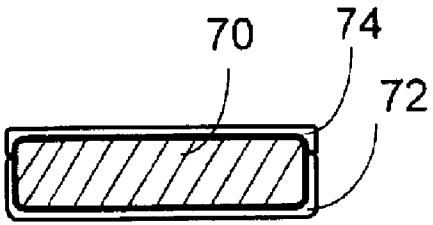
FIG. 13B shows the ribbon wire of FIG. 13A with copper electroplated on the top of the ribbon wire in accordance with the present invention.

Another form of capture device is to coat the top of the ribbon wire with a softer material that will capture a sharp instrument. One technique is to electroplate the top of the ribbon wire with copper. FIG. 13A shows a ribbon wire 70 with a coating 72 on the bottom to mask the bottom of the ribbon wire. The coating 72 can be a solvent soluble polymer, which is washed off after the plating process. FIG. 13B shows the ribbon wire 70 of FIG. 13A with copper 74 electroplated on the top of the ribbon wire. The plating can be configured as a reel to reel or continuous process.

Figure 14:
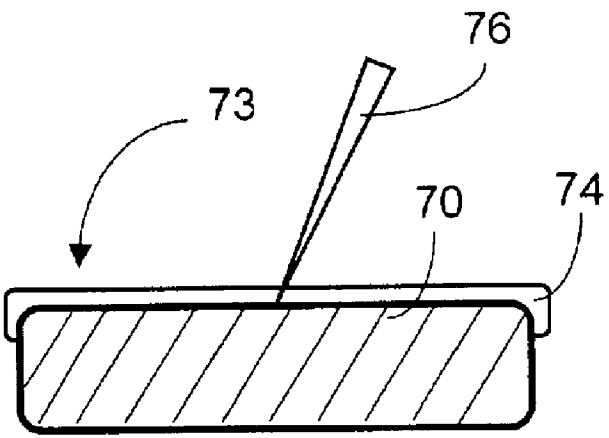
FIG. 14 shows the ribbon wire of FIG. 13B with the coating on the bottom removed and showing a needle being captured by the soft copper in accordance with the present invention.

Multiple layers of woven strips formed of copper coated ribbon wire are stacked or layered in a random manner, each layer to the next, simplifying fabrication and manufacturing. The soft copper captures a sharp instrument, such as a needle. An advantage of this implementation of a capture device is that the entire surface functions as a capture mechanism. FIG. 14 shows the copper coated ribbon wire 73 with the coating on the bottom removed and showing a needle 76 being captured by the soft copper 74 on the top of the ribbon wire 70. As discussed above any voids at the intersections of the warp and weft of the woven strips are potential paths for a needle to pass through; however, a four layer stack of woven mats, layered in a random manner, has a probability of a puncture of only 1 in 25,000,000.

Figure 15:
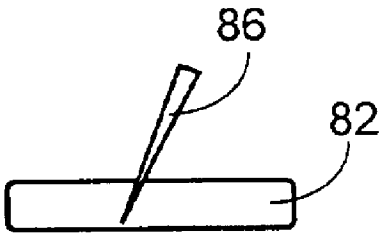
FIG. 15 is a cross section of a metal foil that has been annealed to lower the tensile strength to 110 PSI (pounds per square inch) to form a capture device in accordance with the present invention.
Figure 16:
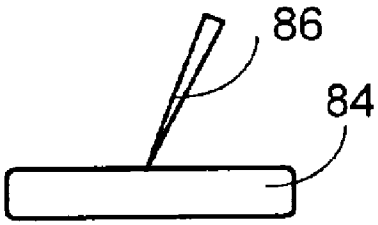
FIG. 16 is a cross section of a metal foil having a tensile strength of about 285 PSI in accordance with the present invention.

Another capture device implementation is to combine layers woven of metal foil of normal hardness (tensile strength 285 PSI) with a top layer woven of metal foil of softer hardness (tensile strength 110 PSI). A process of annealing the harder metal foil to lower the tensile strength from about 285 PSI to about 110 PSI forms the softer metal foil. FIG. 15 is a cross section of a metal foil 82 that has been softened by annealing to about 110 PSI to provide a capture device for a sharp instrument, such as needle 86. As shown in FIG. 15, the softer metal foil provides a capture device for the needle 86 by being soft enough that the needle penetrates or punctures the soft metal foil and is captured. FIG. 16 is a cross section of a metal foil 84 having the harder tensile strength of about 285PSI, which, as shown, is hard enough to prevent puncture by needle 86; however the metal foil 86 is also too hard to capture the needle 86.

Figure 17:
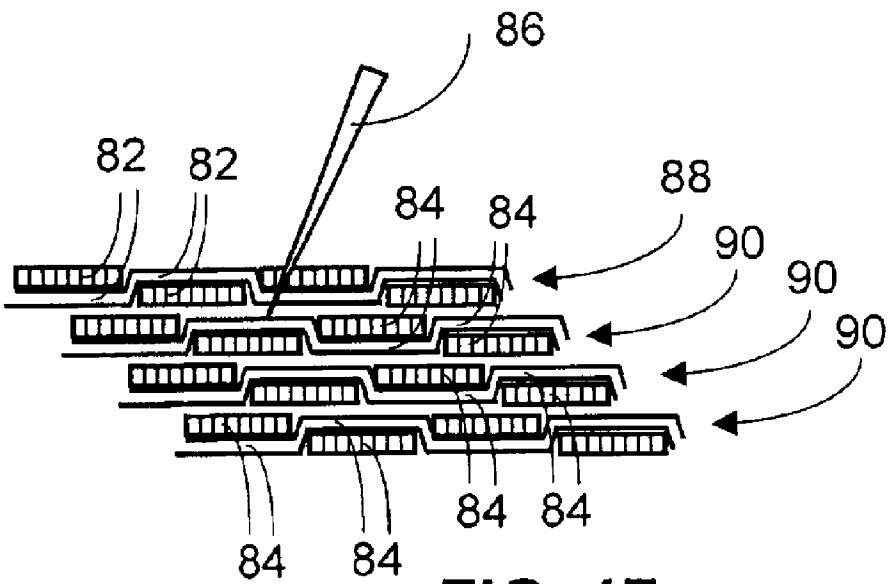
FIG. 17 is a cross section a puncture proof material formed of multiple layers of woven metal foil strips with the top layer being woven of a lower tensile strength metal foil to provide for capture and the other layers being woven of a higher tensile strength metal foil to prevent puncture in accordance with the present invention.

FIG. 17 is a cross section of multiple layers of woven metal foil. The top layer 88 is woven of the softer metal foil 82 in both the warp and weft of the weave. This top layer 88 provides a capture device for any sharp instrument, which prevents the sharp instrument from skidding along the puncture proof material and coming into contact with a body area not protected by puncture proof material. If the sharp instrument encounters a void between the warp and weft, then the sharp instrument will be captured by the void. The other layers 90 are woven of the harder metal foil 84 in both the warp and the weft. The preferred dimensions of the metal foil used for both layers 88 and 90 are about ½ mil (0.0005 inches) thick by about 30 to 40 mils (0.030 to 0.040 inches) in width. The relatively thin thickness (½ mil) of the metal foil provides the required flexibility of the puncture proof material.

The top layer 88 and the second, third and fourth layers 90, as shown in FIG. 17, can be layered in a random manner. As discussed above any voids at the intersections of the warp and weft of the woven strips are potential paths for a needle to pass through. However, for a four layer stack of woven mats layered in a random manner, there is only a probability of puncture of 1 in 25,000,000.

Another form of capture device is to use very low tensile strength materials such as polymers for their capture properties. An example is Kapton, which has a tensile strength of 33K PSI compared to ribbon wire with a tensile strength of 285 PSI. Polymer is soft enough that "capture" is not a problem, but the required aggregate tensile strength can be reached only by using multiple layers and to prevent stiffness, the thinnest material must be used.

Figure 18:
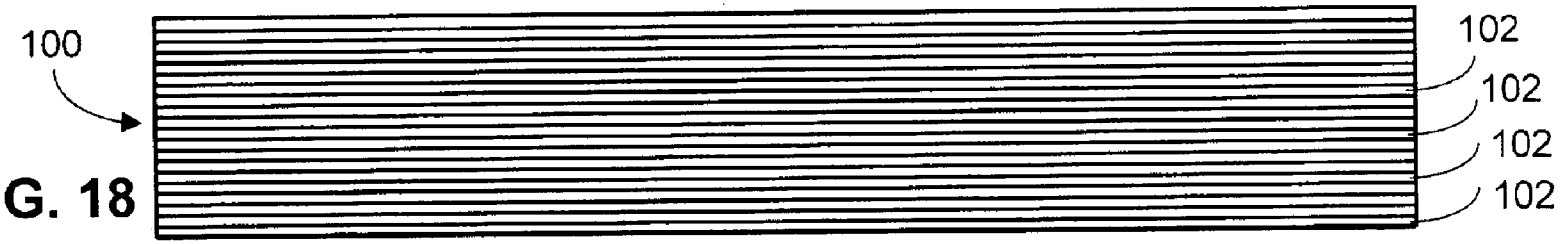
FIG. 18 is a stack of polymer strips in accordance with the present invention.
Figure 19:
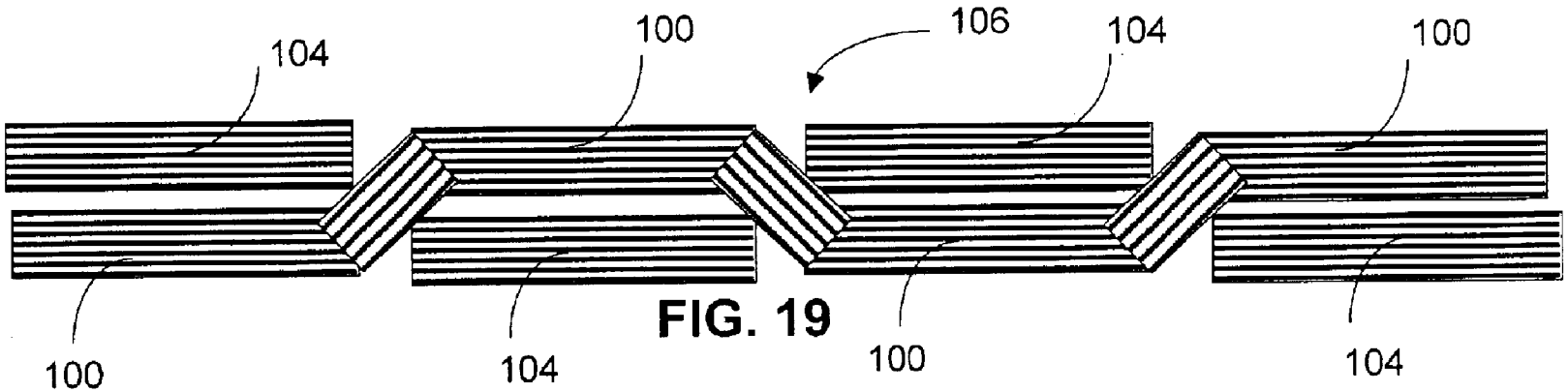
FIG. 19 shows a cross section of a woven layer formed by weaving stacked polymer strips in accordance with the present invention.
Figure 20:
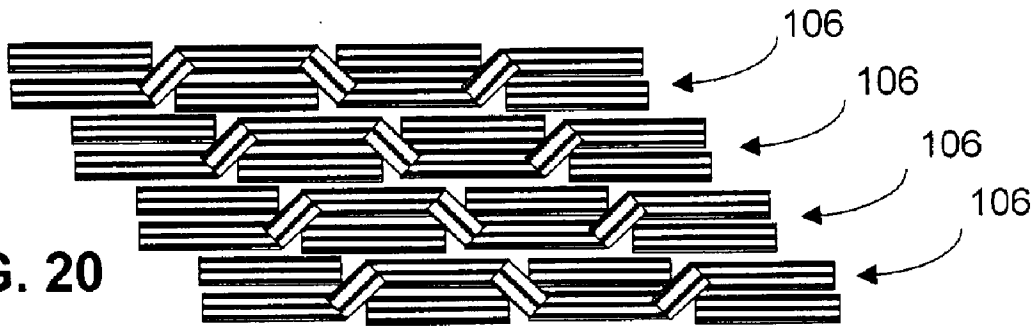
FIG. 20 shows a cross section of multiple overlapped and offset woven layers formed by weaving stacked polymer strips in accordance with the present invention.

FIG. 18 is a stack 100 of polymer strips 102. If a stack of ½ mil Kapton of 40 layers is subjected to puncture testing, it will resist puncture to 1,800 grams; however one layer of Kapton is easily punctured. Therefore, simply forming woven mats of single polymer strips and then utilizing multiple woven layers, in the same manner as described above for ribbon wire, would result in poor puncture resistance. However by forming stacks of strips, as shown in FIG. 18, before weaving (five of 1 mil or ten of ½ mil) two essential properties are enhanced, namely, flexibility of the woven material and puncture resistance. In FIG. 19 a cross section of a woven layer 106 formed by weaving stacked polymer strips 100 and 104, is shown. Stacked polymer strip 104 is formed in the same manner as stacked polymer strip 100. FIG. 20 shows a cross section of multiple overlapped and offset woven layers 106 formed by weaving stacked polymer strips.

The use of "stacks" of five or ten sheets does have the effect of producing a "void", as detailed above for the woven ribbon wire. However, as discussed above random layering makes the probability of a puncture through a void very low, because 4 or 5 such woven layers of the stacked polymer strips would be used, producing a near zero probability of coincident voids.

Under no conditions can any type of adhesive or agent be used to bond the stacked strips or the multiple layers, since this would convert the assembly into a composite with a totally unacceptable degree of stiffness.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope of the present invention and additional fields in which the present invention would be of significant utility.

It is therefore intended by the appended claims to cover any and all such applications, modifications and embodiments within the scope of the present invention.

What is claimed is:

1. A puncture proof material comprising:

a first mat woven of a first plurality of metal strips forming a warp and a second plurality of metal strips forming a weft of said first mat, said first mat having first voids between said first plurality of metal strips forming said warp and said second plurality of metal strips forming said weft, said first voids located at intersections at each of four corners of each crossing of said warp and weft; and each metal strip of said first plurality of metal strips comprising a first plurality of capture devices, each said capture device located in said metal strip, and each said capture device located along said metal strip wherein when said first plurality of metal strips are woven with said second plurality of metal strips, each said capture device is centered between four said intersections at each corner of each crossing of said warp and weft.

2. The puncture proof material of claim 1 further comprising:

a second mat woven of a third plurality of metal strips forming a warp and a fourth plurality of metal strips forming a weft of said second mat, said second mat having second voids between said third plurality of metal strips forming said warp and said fourth plurality of metal strips forming said weft, said second voids located at intersections at each corner of each crossing of said warp and weft; and said first woven mat overlaying said second woven mat and offset such that said first voids at said intersections of said warp and weft of said first woven mat and said second voids at said intersections of said warp and weft of said second woven mat do not align.

3. The puncture proof material of claim 1 further comprising:

each metal strip of said second plurality of metal strips comprising a second plurality of capture devices, each said capture device located in said metal strip, and each said capture device located along said metal strip wherein when said first plurality of metal strips are woven with said second plurality of metal strips, each said capture device is centered between four said intersections at each corner of each crossing of said warp and weft.

4. The puncture proof material of claim 3 further comprising:

a second mat woven of a third plurality of metal strips forming a warp and a fourth plurality of metal strips forming a weft of said second mat, said second mat having second voids between said third plurality of metal strips forming said warp and said fourth plurality of metal strips forming said weft, said second voids located at intersections at each corner of each crossing of said warp and weft; and said first woven mat overlaying said second woven mat and offset such that said first voids at said intersections of said warp and weft of said first woven mat and said second voids at said intersections of said warp and weft of said second woven mat do not align.

5. The puncture proof material of claim 1 wherein each said capture device in each said metal strip of said first plurality of metal strips comprises an opening forming a hole in said metal strip centered between four said intersections at each corner of each crossing of said warp and weft.

6. The puncture proof material of claim 3 wherein:

each said capture device in each said metal strip of said first plurality of metal strips comprises an opening forming a hole in said metal strip centered between four said intersections at each corner of each crossing of said warp and weft; and each said capture device in each said metal strip of said second plurality of metal strips comprises an opening forming a hole in said metal strip centered between four said intersections at each corner of each crossing of said warp and weft.

7. The puncture proof material of claim 6 wherein each said hole comprises a beveled side.

8. The puncture proof material of claim 4 further comprising:

a third mat woven of a fifth plurality of metal strips forming a warp and a sixth plurality of metal strips forming a weft of said third mat, said third mat having third voids between said fifth plurality of metal strips forming said warp and said sixth plurality of metal strips forming said weft, said third voids located at intersections at each corner of each crossing of said warp and weft; and said second woven mat overlaying said third woven mat and offset such that said second voids at said intersections of said warp and weft of said second woven mat and said third voids at said intersections of said warp and weft of said third woven mat do not align.

9. The puncture proof material of claim 1 wherein each of said first and second plurality of metal strips comprise metal strips approximately 1 mil in thickness and approximately 15 mils in width.

10. The puncture proof material of claim 8 wherein said first, second and third overlapping woven mats are coupled to maintain registration of said overlapping woven mats.

11. The puncture proof material of claim 1 wherein each said capture device in each said metal strip of said first plurality of metal strips comprises a depression in said metal strip centered between four said intersections at each corner of each crossing of said warp and weft.

12. The puncture proof material of claim 3 wherein:

each said capture device in each said metal strip of said first plurality of metal strips comprises a depression in said metal strip centered between four said intersections at each corner of each crossing of said warp and weft; and each said capture device in each said metal strip of said second plurality of metal strips comprises a depression in said metal strip centered between four said intersections at each corner of each crossing of said warp and weft.

* * * * *